US006899385B2

(12) United States Patent
Pernicka et al.

(10) Patent No.: US 6,899,385 B2
(45) Date of Patent: May 31, 2005

(54) AUDITORIUM SEATING

(75) Inventors: Vaclav Pernicka, Brampton (CA); Michael Shats, Thornhill (CA)

(73) Assignee: Global Total Office, An Ontario Limited Partnership having Global Upholstery Co. Inc. as its general partner, Downsview (CA)

( * ) Notice: Subject to any disclaimer, the term of this patent is extended or adjusted under 35 U.S.C. 154(b) by 0 days.

(21) Appl. No.: 10/651,239

(22) Filed: Aug. 29, 2003

(65) Prior Publication Data

US 2005/0046257 A1 Mar. 3, 2005

(51) Int. Cl.[7] ..... A47B 83/02
(52) U.S. Cl. ..... 297/142; 297/344.21; 297/344.24
(58) Field of Search ..... 297/142, 344.22, 297/344.21, 135, 137, 141, 147, 158.2, 423.3, 297/344.13, 344.24, 249, 248, 423.38; 248/417, 248/282, 283, 425

(56) References Cited

U.S. PATENT DOCUMENTS

| | | | | | |
|---|---|---|---|---|---|
| 1,876,308 | A | * | 9/1932 | Colley et al. | 297/142 |
| 2,024,045 | A | * | 12/1935 | Johnson | 297/142 |
| 3,419,305 | A | * | 12/1968 | Baran | 297/232 |
| 3,486,790 | A | * | 12/1969 | Barecki et al. | 297/142 |
| 3,535,000 | A | * | 10/1970 | Protzmann | 297/142 |
| 3,542,424 | A | * | 11/1970 | Khan et al. | 297/344.24 |
| 3,708,203 | A | * | 1/1973 | Barecki et al. | 297/344.13 |
| 3,709,555 | A | * | 1/1973 | Ostertag | 297/142 |
| 3,990,663 | A | | 11/1976 | Henderickson et al. | |
| D246,813 | S | | 1/1978 | Tolleson | |
| 4,159,846 | A | | 7/1979 | Tolleson | |
| 4,386,804 | A | | 6/1983 | Ware et al. | |
| 4,850,159 | A | | 7/1989 | Conner | |
| 4,872,635 | A | * | 10/1989 | Knoblock et al. | 248/406.2 |
| D308,143 | S | | 5/1990 | Lohmeyer | |
| 5,035,466 | A | | 7/1991 | Mathews et al. | |
| 5,040,846 | A | | 8/1991 | Finney et al. | |
| D339,940 | S | | 10/1993 | Balderi et al. | |

(Continued)

FOREIGN PATENT DOCUMENTS

| | | |
|---|---|---|
| CA | 651111 | 10/1962 |

(Continued)

OTHER PUBLICATIONS

Mary Lebeau, Kruger International, Torsion Fixed Seating Sell Sheet ki-00426, Sep. 10, 2001.

(Continued)

*Primary Examiner*—Peter M. Cuomo
*Assistant Examiner*—Stephen D'Adamo
(74) *Attorney, Agent, or Firm*—Bereskin & Parr

(57) ABSTRACT

A seating apparatus has a support element having an upright extending from a floor and a swing arm pivotably mounted to the upright about a generally vertical pivot axis. A work surface is secured to the upright above the swing arm, and a seat is mounted on the swing arm, the seat having a seat base upon which an occupant can be seated. The swing arm is pivotable between a stowed position wherein the seat base is tucked substantially underneath the work surface, and a deployed position wherein the seat base is substantially clear of the work surface. The seating apparatus is also provided with a flat coiled torsion spring for biasing the arm to the stowed position, the torsion spring having a first end fixed directly or indirectly to the upright and a second end fixed directly or indirectly to the swing arm.

22 Claims, 9 Drawing Sheets

U.S. PATENT DOCUMENTS

| | | | | |
|---|---|---|---|---|
| 5,292,177 | A | | 3/1994 | Balderi et al. |
| 5,393,120 | A | | 2/1995 | Woods et al. |
| 5,462,338 | A | | 10/1995 | Baumann |
| 5,556,164 | A | * | 9/1996 | Cindea et al. ..... 297/344.22 |
| 5,559,411 | A | | 9/1996 | Winship |
| 5,567,016 | A | | 10/1996 | Koprowski |
| 5,586,804 | A | | 12/1996 | Burroughs |
| 5,601,335 | A | | 2/1997 | Woods et al. |
| D379,295 | S | | 5/1997 | Kopish |
| D382,736 | S | | 8/1997 | Kopish |
| 5,683,136 | A | | 11/1997 | Baumann et al. |
| 5,683,142 | A | | 11/1997 | Gunderson et al. |
| D390,024 | S | | 2/1998 | DeJule |
| 5,899,531 | A | | 5/1999 | Koehler |
| D410,808 | S | | 6/1999 | Baumann |
| D412,622 | S | | 8/1999 | DeJule |
| 5,951,110 | A | | 9/1999 | Conner et al. |
| D415,912 | S | | 11/1999 | Baumann et al. |
| D416,407 | S | | 11/1999 | Baumann et al. |
| D417,570 | S | | 12/1999 | Baumann et al. |
| D420,540 | S | | 2/2000 | Baumann et al. |
| 6,022,077 | A | * | 2/2000 | Kirkland et al. ..... 297/344.19 |
| 6,033,027 | A | | 3/2000 | Conner et al. |
| 6,042,187 | A | | 3/2000 | Conner et al. |
| 6,116,555 | A | | 9/2000 | Claus et al. |
| 6,168,239 | B1 | | 1/2001 | Conner et al. |
| 6,179,381 | B1 | | 1/2001 | Gevaert |
| 6,199,325 | B1 | | 3/2001 | Winship |
| D440,422 | S | | 4/2001 | DeJule |
| 6,224,149 | B1 | | 5/2001 | Gevaert |
| D464,209 | S | | 10/2002 | Piretti |
| 6,460,932 | B1 | | 10/2002 | Kopish et al. |

FOREIGN PATENT DOCUMENTS

| | | |
|---|---|---|
| CA | 731439 | 4/1966 |
| CA | 1312815 | 1/1993 |
| CA | 2167139 | 7/1996 |
| CA | 2114654 | 10/1998 |
| CA | 2257445 | 7/1999 |
| CA | 2273562 | 7/1999 |
| CA | 2165504 | 9/1999 |
| CA | 2099165 | 3/2000 |
| CA | 2322095 | 4/2001 |
| CA | 2322985 | 5/2001 |
| CA | 2208810 | 10/2001 |
| CA | 2341342 | 12/2001 |
| CA | 2212108 | 2/2002 |

OTHER PUBLICATIONS

Krueger, University Seating Installation Instructions, Mar. 2, 1999.

* cited by examiner

AUDITORIUM SEATING

FIELD OF THE INVENTION

This invention relates to a seating apparatus for use in auditoriums, lecture halls, cafeterias, meeting rooms, and the like.

BACKGROUND OF THE INVENTION

Seating systems that provide seating with attached desks or work surfaces are often convenient for use in lecture halls, classrooms, meeting rooms, or similar facilities. Some existing seating systems of this type have desks or work surfaces supported above a floor by structural support elements. Seats are attached to the support elements by a pivot arm extending from the support element, so that the seat can be stowed under the desk when not in use.

It is known to include biasing means in these seating systems to bias the swing arm to the stowed position. The biasing means in known seating systems comprises a tension spring having one end fixed to the structural member, and the other end fixed at a point along the length of the arm. The tension springs can be difficult to install, and generally remain exposed so that they are prone to damage and/or premature wear.

Furthermore, in known seating systems having seats attached to pivot arms, the angular position of the pivot arm relative to the structural member defining the stowed position is not adjustable once the seating system has been manufactured and assembled. Accordingly, due to variations in the manufacturing and assembly of the seating systems, adjacent seats in a row of seating may not have uniform stowed positions. In other words, some seats may be spaced away from the work surface when in the stowed position, while other seats may touch the work surface when in the stowed position. An excessive gap between the seat and the desk when in the stowed position can obstruct aisles between adjacent rows of seats. Having no space at all between the seat and the desk when in the stowed position can cause wear or damage to the seat and the desk. As well, seats having different spacings between the seats and the desk when in the stowed position can create an untidy appearance.

With respect to the structural members of the known seating systems, uprights having a vertical lower portion and an inclined upper portion are generally used to support the work surface above the floor. The upper and lower portions of the uprights are typically constructed of square or rectangular steel channel, with a welded joint provided between the upper and lower portions. Accordingly, the uprights can be rather costly.

It is also known in existing seating systems to provide a swivel joint between the chair and the pivot arm to which it is attached. Providing an auto-orientation feature whereby the seat is biased towards the forward direction is also a known feature. Examples of existing swivel joints comprise dual inner and outer compression springs, thrust bearings, and co-operating cam surfaces. These joints are rather complex and can be costly to produce.

SUMMARY OF THE INVENTION

It is an object of the present invention to provide an improved seating apparatus and elements of a seating system suitable for use in, lecture halls, classrooms, cafeterias, meeting rooms, and the like.

According to one aspect of the present invention, a seating apparatus has a support element having an upright extending from a floor and a swing arm pivotably mounted to the upright about a generally vertical pivot axis. The seating apparatus is further provided with a work surface secured to the upright above the swing arm, and a seat mounted on the swing arm, the seat having a seat base upon which an occupant can be seated. The swing arm is pivotable between a stowed position wherein the seat base is tucked substantially underneath the work surface, and a deployed position wherein the seat base is substantially clear of the work surface. The seating apparatus is also provided with a flat coiled torsion spring for biasing the arm to the stowed position, the torsion spring having a first end fixed directly or indirectly to the upright and a second end fixed directly or indirectly to the swing arm.

The flat coiled torsion spring can be of a thin strip of resilient metal coiled in a flat spiral about the pivot axis. The arm can be pivotable about a pivot joint having upper and lower brackets extending from the upright to vertically straddle an inner end of the arm, a bore provided in the straddled inner end of the arm, and a generally vertical pin supported by the brackets and extending through the bore of the arm, the arm being pivotable about the pin.

The seating apparatus can be provided with a boss fixed to pivot with the arm, the boss extending axially between the arm and an adjacent one of the upper and lower brackets of the pivot joint. The pivot joint can include a bushing provided in the bore, the bushing having an outer surface sized to fit snugly within an inner surface of the bore, and an inner diameter sized to provide a sliding fit with the pin. The boss can extend from the bushing.

The seating apparatus can further include anti-rotate means adjacent the bushing and the bore for preventing relative motion between the bushing and bore. The anti-rotate means can include an axial groove along the outer surface of the bushing and a radially inwardly directed key extending from the inner surface of the bore and engaging the groove of the bushing.

The second end of the torsion spring can be fixed to the boss, and the first end of the torsion spring can be fixed to the adjacent one of the upper and lower brackets of the pivot joint. The adjacent one of the upper and lower brackets can have a generally vertical gusset with an exposed edge extending adjacent the boss.

11. The apparatus of claim 10 wherein the first end of the torsion spring comprises a radially outwardly extending hook that is hooked onto the exposed edge of the gusset. The boss can extend axially through the center of the torsion spring, and the second end of the torsion spring can have a tab directed radially inwardly, and the boss can have a transverse slot to engage the tab.

The seating apparatus can further be provided with a swivel mechanism for swivelably supporting the seat above the swing arm, the swivel mechanism biasing the seat in a central direction. The swivel mechanism can have a sleeve fixed to an outer end of the swing arm, the sleeve having open upper and lower ends, a post rotatable within the sleeve, the post having an upper end for attachment to a seat, an upper cam fixed within the sleeve and a lower cam fixed to the post and slidable within the sleeve. The upper cam can be disposed between the lower cam and the upper end of the post, and the upper and lower cams can have matching inclined annular lower and upper surfaces, respectively. The position of the lower cam relative to the upper cam that provides generally flush contact of the matching inclined annular surfaces defines the central position of the swivel mechanism. The swivel mechanism can also have a compression spring urging the lower cam against the upper cam.

According to a second aspect of the invention, a support element for a seating apparatus has an upright for supporting a work surface above a floor. A swing arm for supporting a seat is pivotably mounted to the upright and pivotable between a stowed position wherein a seat supported by the swing arm is substantially underneath a work surface supported by the upright, and a deployed position wherein a seat supported by the swing arm is substantially clear of a work surface supported by the upright. A flat coiled torsion spring is provided for biasing the arm to the stowed position, the torsion spring having a first end fixed directly or indirectly to the upright and a second end fixed directly or indirectly to the swing arm.

According to a third aspect of the invention, a seating apparatus has a support element having an upright extending from a floor and a swing arm pivotably mounted to the upright about a generally vertical pivot axis. A work surface is secured to the upright above the swing arm. A seat is mounted on the swing arm, the seat having a seat base upon which an occupant can be seated. The swing arm is pivotable between a stowed position wherein the seat base is tucked substantially underneath the work surface, and a deployed position wherein the seat base is substantially clear of the work surface. A dynamic return stop element is secured to the arm and a static return stop element is secured to the upright, the dynamic and static return stop elements positioned in a common horizontal plane and abutting each other when the arm is in the stowed position. At least one of the static and dynamic return stop elements is adjustable to change the angular position of the arm relative to the upright corresponding to the position at which the dynamic and static return stop elements abut.

The dynamic return stop element can include an eccentrically mounted button, the button having an attachment axis about which the button can be rotatably adjusted, and an outer surface spaced laterally away from the attachment axis for contacting the static return stop element. The static return stop element can include a bracket extending from the upright. The bracket can have at least one generally vertical gusset, and the static return stop element can include an exposed edge of the gusset.

The seating apparatus according to the third aspect of the invention can further be provided with biasing means for biasing the arm to the stowed position. The biasing means can include a flat coiled torsion spring, the torsion spring having a first end fixed directly or indirectly to the upright and a second end fixed directly or indirectly to the swing arm.

According to a fourth aspect of the invention, a seating apparatus has a support element having an upright extending from a floor and a swing arm pivotably mounted to the upright about a generally vertical pivot axis. A work surface is secured to the upright above the swing arm. A seat is mounted on the swing arm, the seat having a seat base upon which an occupant can be seated. The swing arm is pivotable between a stowed position wherein the seat base is tucked substantially underneath the work surface, and a deployed position wherein the seat base is substantially clear of the work surface. The upright is generally straight, and inclined to the vertical such that, relative to a direction in which the seating apparatus is facing, the upper end of the upright is forward of the pivot joint, and the pivot joint is forward of the lower end of the upright.

The upright can have upper and lower ends that are generally perpendicular to the axis of the uprights. A work surface mounting bracket can be provided adjacent the upper end of the upright for mounting the work surface obliquely with respect to the generally perpendicular upper end of the upright.

BRIEF DESCRIPTION OF THE DRAWINGS

For a better understanding of the present invention and to show more clearly how it may be carried into effect, reference will now be made by way of example, to the accompanying drawings that show embodiments of the present invention, and in which.

DETAILED DESCRIPTION OF THE INVENTION

Figure 1:
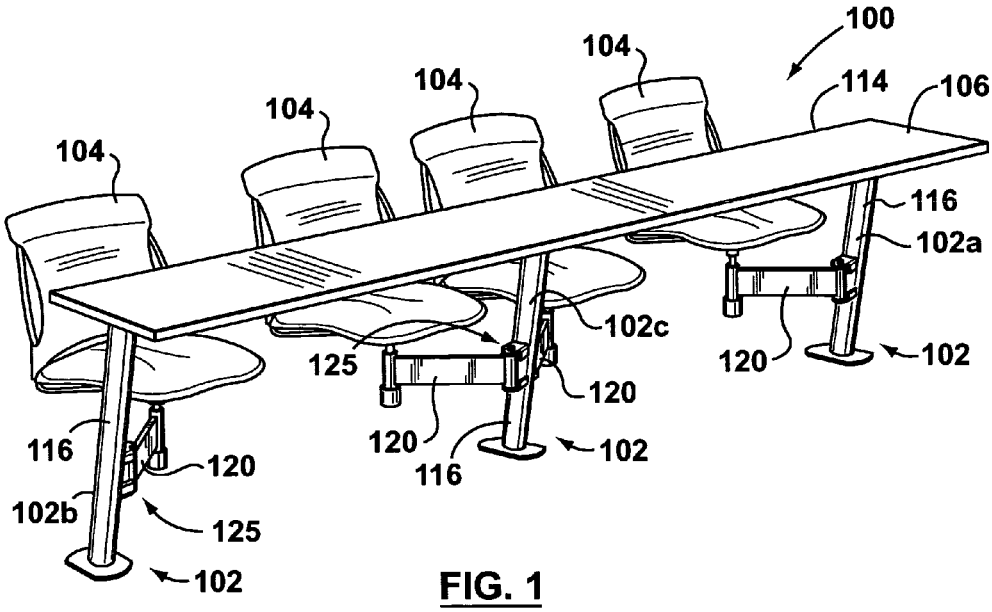
FIG. 1 is a perspective view of one embodiment of a seating apparatus according to the present invention.
Figure 2:
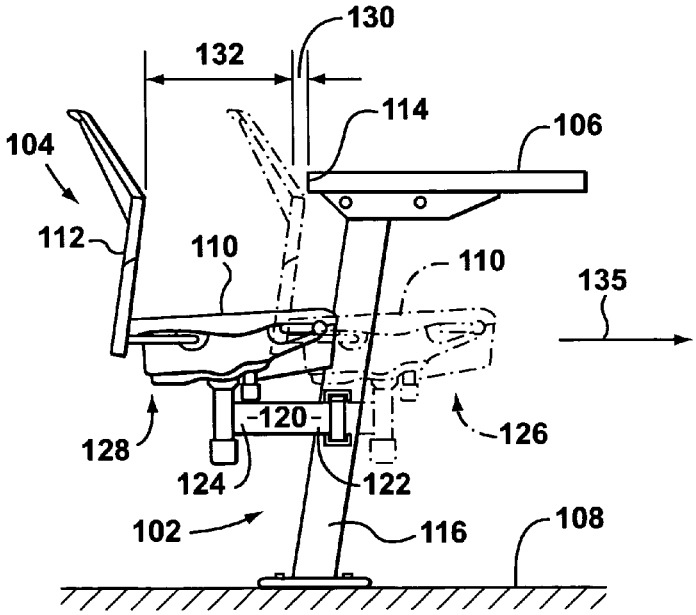
FIG. 2 is a side view of the apparatus of FIG. 1.

A seating apparatus according to the present invention is shown generally at 100 in the Figures. Referring to FIGS. 1 and 2, the apparatus 100 has at least one support element 102 for supporting a seat 104 and a work surface 106 above a floor 108.

The seats 104 can have a seat base 110 and a backrest 112. The work surface 106 can be a panel constructed of high pressure laminate. The work surface 106 presents an adjacent edge 114 that faces the backrests 112 of the seats 104.

Each support element 102 comprises an upright 116 and at least one swing arm 120 pivotably mounted to the upright 116. Each swing arm 120 has an inner end 122 and an outer end 124. The inner end 122 of the swing arm 120 is pivotably attached to the upright 116 by means of a pivot joint 125. The outer ends 124 of the swing arms 120 support the seats 104.

The swing arms 120 are pivotable between stowed positions, identified at 126 (in phantom line) in FIG. 2, and deployed positions, identified at 128 (in solid line) in FIG. 2. In the stowed position 126, the seat bases 110 of the seats 104 are tucked substantially underneath the work surface 106. In the deployed position 128, the seat bases 110 of the seats 104 are substantially clear of the work surface 106 a sufficient extent so that a user (not shown) can enter, exit, and sit in the seat 104.

Furthermore, when the arm 120 is in the stowed position 126, the backrest 112 of the seat 104 either abuts the adjacent edge 114 of the work surface 106, or is spaced away from the adjacent edge 114 by a relatively narrow gap 130 (as illustrated in FIG. 2). When in the deployed position 128, a relatively large access space 132 is provided between the backrest 112 of the seat 104 and the adjacent edge 114 of the work surface 106, again allowing a user to enter, exit, and sit in the seat 104.

Figure 3:
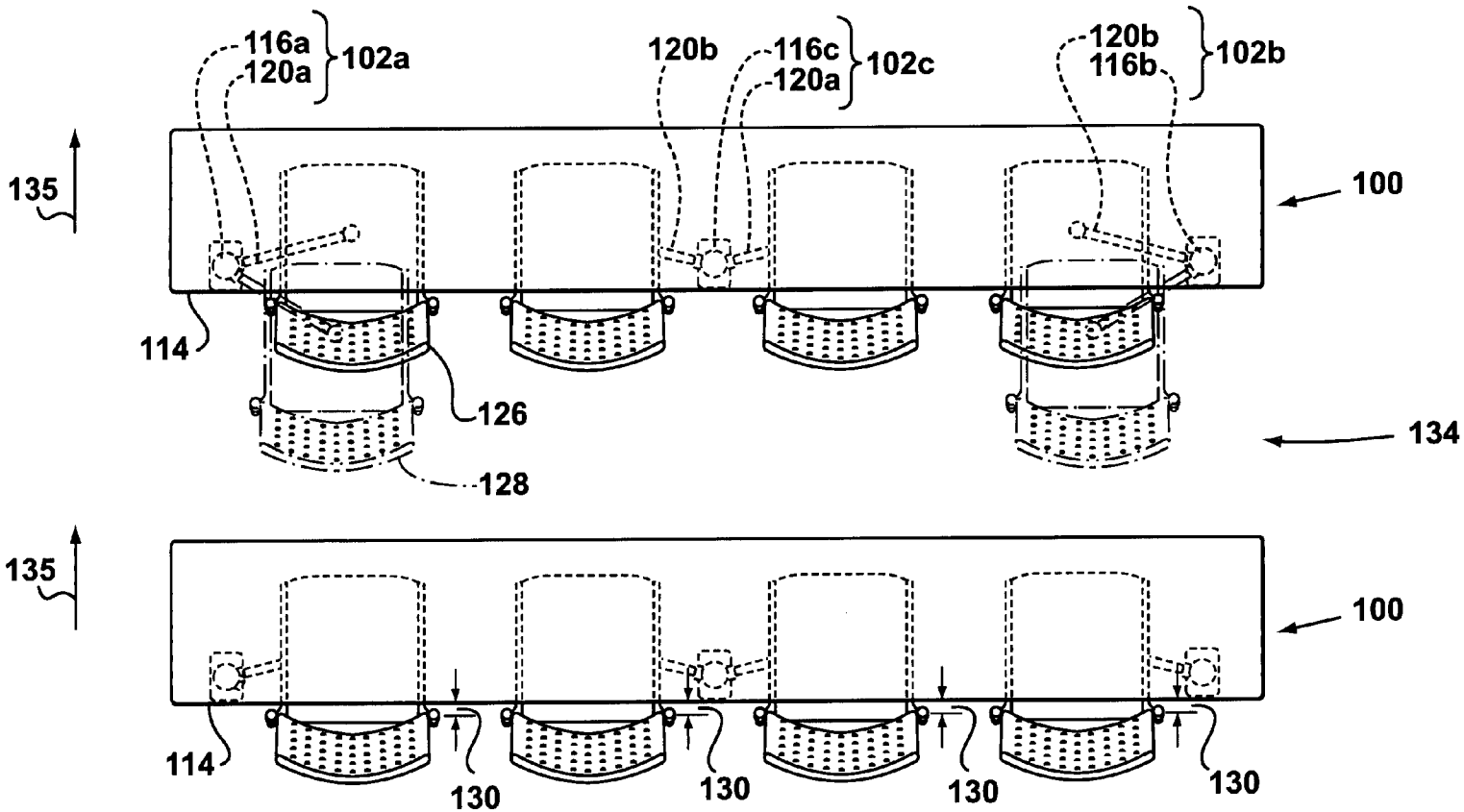
FIG. 3 is a top view of two rows of the seating apparatus of FIG. 1.

Providing the seat base 110 of the seat 104 in a position clear of the work surface 106, and providing the access space 132 between the backrest 112 of the seat 104 and the adjacent edge 114 of the work surface 106, can facilitate entry and exit of an occupant of the seat 104. Returning the seat 104 to the stowed position 126 can provide improved passage behind the seats 104, such as in aisles 134 between adjacent rows of the seating apparatus 100 (FIG. 3).

In the embodiment illustrated, three support elements 102 are used to support an elongate work surface 106, providing a single row of four seats 104. As best seen in FIG. 3, with respect to a forward facing direction indicated by arrow 135, the three support elements 102 include a left, a right, and a center support element 102*a*, 102*b* and 102*c*, respectively.

The left support element 102*a* has an upright 116*a* with a single arm 120*a* extending to the right of the upright 116*a*. The arm 120*a* rotates clockwise (when viewed from above) to pivot from the stowed position to the deployed position.

The right support element 102*b* has an upright 116*b* with a single arm 120*b* extending to the left of the upright 116*b*. The arm 120*b* rotates counter-clockwise (when viewed from above) to pivot from the stowed position to the deployed position. The center support element 102 has an upright 116*c* with two arms 120, namely one arm 120*a* and one arm 120*b*, extending to the left and right, respectively, of the upright 116*c*.

Although three distinct support elements 102*a*, 102*b*, and 102*c* are included in the apparatus 100, it will be readily understood that the corresponding uprights 116 and arms 120 are similar in construction, having elements that are identical or simply mirror images of each other. Accordingly, in the following description, references to a generic support element 102, upright 116, and arm 120 pertain to any one of the three support elements 102*a*, 102*b*, 102*c*, the three uprights 116*a*, 116*b*, 116*c*, and the two arms 102*a*, 102*b*. For clarity, the positions of the support element 102 shown in FIG. 4 (and following) are of a left support element 102*a*.

Figure 4:
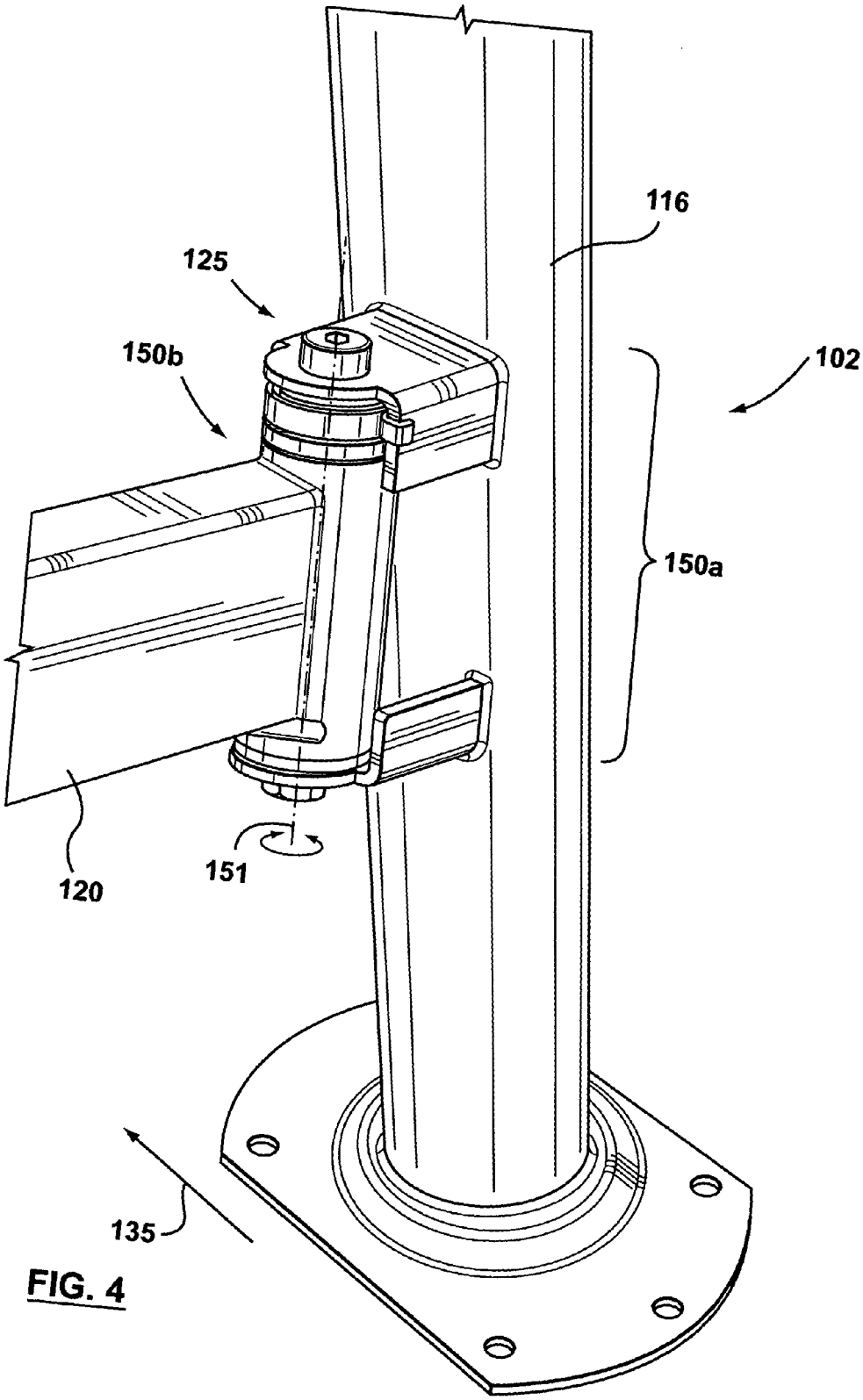
FIG. 4 is an enlarged perspective view of a portion of the apparatus of FIG. 1.

Referring now to FIG. 4, the pivot joint 125 of the support element 102 provides a generally vertical pivot axis 151 about which the arm 120 can pivot. In the embodiment illustrated, the pivot joint 125 comprises a stationary portion 150*a* fixed to the upright 102, and a pivoting portion 150*b* fixed to the arm 120.

Figure 5:
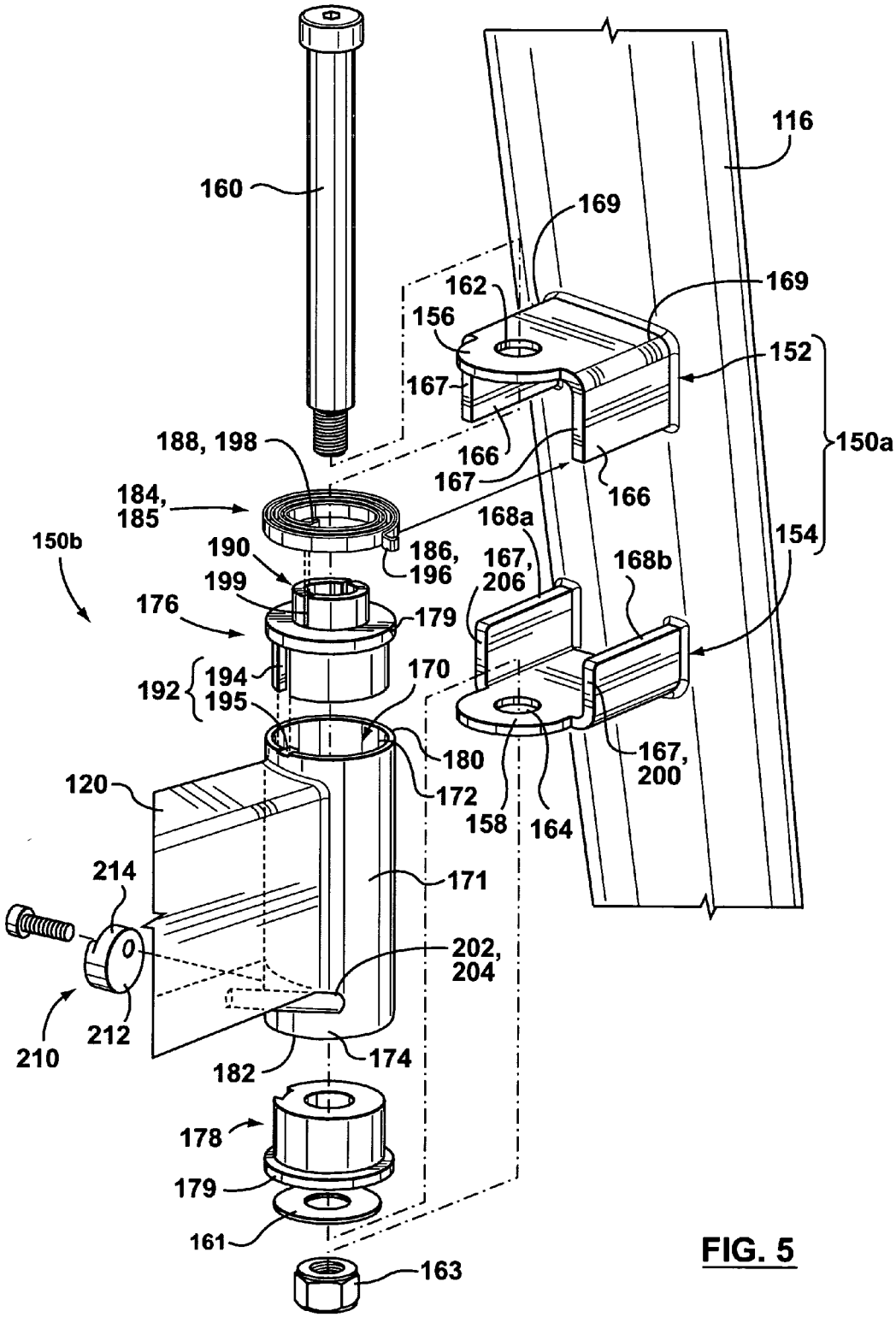
FIG. 5 is an exploded view of the portion of the apparatus of FIG. 1 shown in FIG. 4.

As best seen in FIG. 5, the stationary portion 150*a* of the pivot joint 125 has upper and lower pivot joint brackets 152, 154, respectively, that extend from the upright 116. The brackets 152, 154 are spaced apart along the length of the upright 116 to vertically straddle the inner end 122 of the arm 120. The upper pivot joint bracket 152 and lower pivot joint bracket 154 have opposed upper and lower horizontal plates 156 and 158, respectively. Vertically aligned upper and lower apertures 162, 164 are provided in the upper and lower plates 156, 158, respectively. An elongate pin 160 extends through the apertures 162, 164 and is secured with a washer 161 and a nut 163 threaded on to the lower portion of the pin 160. The axis of the pin 160 corresponds to the pivot axis 151 about which the arm 120 can pivot.

In the illustrated embodiment, as best seen in FIG. 5, the upper and lower brackets 152, 154 further comprise generally vertical gussets 166, 168, respectively, which are secured to the upright 116 and extend generally perpendicularly from the transverse edges 169 of the horizontal plates 156, 158. The gussets 166 of the upper bracket 152 are directed downwardly, and the gussets 168 of the lower bracket 154 are directly upwardly. The gussets 166, 168 serve to brace the horizontal plates 156, 158 of the upper and lower brackets 152, 154, respectively, and can provide other functions as will be described hereinafter.

The pivoting portion 150*b* of the pivot joint 125 comprises a generally vertical bore 170 extending through the inner end 122 of the arm 120. The bore 170 can be substantially cylindrical, having a cylindrical wall 171 with open upper and lower ends 172, 174, respectively. The bore 170 is aligned with the apertures 162, 164 of the upper and lower pivot brackets 152, 154, respectively, and the pin 160 extends through the bore 170 so that the arm 120 may pivot about the pin 160.

Upper and lower annular bushings 176, 178 can be provided at the upper and lower ends 172, 174, respectively, of the bore 170 to enhance the pivoting action of the arm 120 about the pivot axis 151. In the embodiment illustrated, the bushings 176, 178 have an inner diameter sized to provide a sliding fit with the pin 160, and an outer diameter sized to fit snugly within the bore 170. Furthermore, the upper and lower bushings 176, 178 have flanges 179 that engage the upper and lower faces 180, 182, respectively, of the arm 120 adjacent the bore 170, thereby keeping the bushings 176, 178 from migrating inwards from the opposed ends 172, 174 of the bore 170. The bushings 176, 178 can be constructed of a relatively hard, wear-resistant material, such as for example, an injection molded plastic or nylon.

Referring still to FIG. 5, the seating apparatus 100 is further provided with biasing means 184 for biasing the swing arm 120 to the stowed position 126. The biasing means 184 can advantageously comprise a flat coiled torsion spring 185 having a first end 186 fixed directly or indirectly to the upright 116, and a second end 188 fixed directly or indirectly to the arm 120. In the illustrated embodiment, the torsion spring 185 is fitted in the pivot joint 125 of the apparatus 100. More particularly, the torsion spring 185 comprises a thin strip of resilient metal coiled in flat spiral about the pivot axis 151. The torsion spring 185 is positioned between the flange 179 of the upper bushing 176 and the horizontal plate 156 of the upper bracket 152.

An axially extending boss 190 is provided between the flange 179 of the upper bushing 176 and the horizontal plate 156 of the upper bracket 152. The boss 190 has an outer diameter that is smaller than the inner diameter of the smallest coil of the torsion spring 185, so that the boss 190 can extend axially through the center of the torsion spring 185.

The boss 190 is fixed to pivot with the arm 120. In the embodiment illustrated, the boss 190 extends from the upper bushing 176 of the pivot joint 12. Anti-rotate means 192 are provided adjacent the bushing 176 and the bore 170 for preventing relative rotation between the bushing 176 and the bore 170, and hence, between the boss 190 and the arm 120. The anti-rotate means 192 can comprise an axial groove 194 provided along the outer surface of the bushing 176, and a radially inwardly directed key 195 extending from the inner surface of the bore 170 shaped to fit within the groove 194.

Furthermore, in the embodiment illustrated, the first (radially outermost) end 186 of the torsion spring 185 comprises a radially outwardly extending hook 196 that is hooked onto an exposed vertical edge 167 of the adjacent gusset 166. The second (radially innermost) end 188 of the torsion spring 185 comprises a radially inwardly directed tab 198. The boss 190 is provided with a transverse slot 199 for receiving the tab 198. Accordingly, the first end 186 of torsion spring 185 is fixed to the upright 116, and the second end 188 of the torsion spring 185 is secured to the swing arm 120.

It is to be appreciated that the elements of the pivot joint 125 can be assembled quite easily. In particular, the bushing 176 can be axially inserted into the upper end 172 of the bore 170 of the arm 120 once the groove 194 has been aligned with the key 195. The torsion spring 185 can be placed over the boss 190 of the bushing 176, ensuring that the tab 198 is positioned within the slot 199. With the lower bushing also inserted in the bore 170, the inner end 122 of the arm 120 can be positioned between the plates 156, 158 of the upper and lower brackets 152, 154, respectively.

When inserting the arm 120 between the brackets 152, 154, the hook 196 of the torsion spring 185 can be aligned to engage the edge 167 of the gusset 166. This will generally require a light force on the torsion spring 185, since the torsion spring 185 is preferably pre-loaded. More particularly, the torsion spring 185 can exert a certain pre-load torque on the arm 120 even when the arm 120 is in the stowed position.

Figures 6A, 6B, 6C:
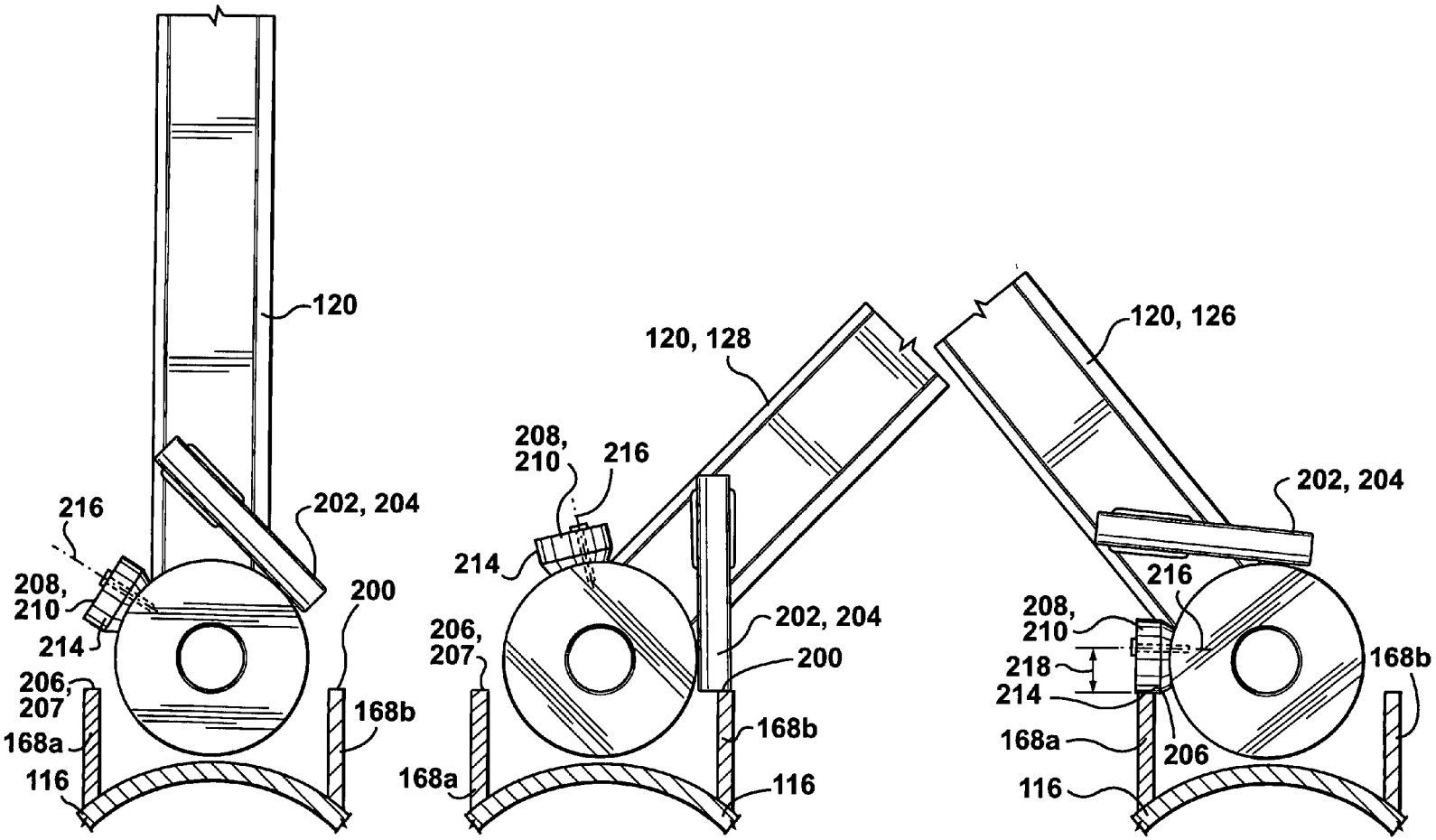
FIGS. 6*a*, 6*b* and 6*c* are bottom views of a portion of the apparatus of FIG. 4 showing an arm in intermediate, deployed, and stowed positions, respectively.

Referring now to FIGS. 5 and 6*a*, to define the deployed position 128 of the arm 120, the seating apparatus 100 can be provided with static and dynamic advanced stop elements 200 and 202, respectively. The static advance stop element 200 is fixed to the upright 116. The dynamic advance stop element 202 is secured to, and moves with, the arm 120. The advance stop elements 200, 202 are positioned relative to each other such that pivoting of the arm 120 from the stowed position 126 to the deployed position 128 causes the dynamic advance stop element 202 to contact the static advance stop element 200, thereby preventing further pivoting of the arm 120 beyond the deployed position 128 (FIG. 6*b*, and shown in phantom in FIG. 3).

In the embodiment illustrated, the static advance stop element 200 comprises the exposed vertical edge 167 of the rear-most gusset 168*b* of the lower pivot joint bracket 154. The dynamic advance stop element 202 comprises a lug 204 welded to the underside of the arm 120.

The apparatus 100 can also be provided with static and dynamic return stop elements 206 and 208, respectively, for defining the stowed position 126 of the arm 120. The static return stop element 206 is fixed to the upright 116, and the dynamic return stop element 208 is secured to the arm 120.

In the embodiment illustrated, the static return stop element 206 comprises the exposed vertical edge 167 of the forward gusset 168*a* of the lower pivot bracket 154. The exposed vertical edge 167 presents a static return abutment surface 207 against which the dynamic return stop 208 can abut.

The dynamic return stop element 208 comprises a button 210 that is secured to the arm 120. The button 210 is generally cylindrical in shape having a generally flat mounting face 212 positioned against the arm 120, and an outer diameter surface 214 for contacting the static return stop element 206.

At least one of the static and dynamic return stop elements 206, 208 may be adjustably secured to the arm 120, so that the stowed position 126 of the arm 120 relative to the upright 116 may be adjusted. In the embodiment illustrated, the button 210 is eccentrically mounted to the arm 120 along a mounting axis 216. Accordingly, rotating the button 210 about the mounting axis 216 changes the distance 218 between the mounting axis 216 and the static return stop 206 when the static return stop 206 is in contact with the surface 214 of the button 210. This in turn changes the angular position of the arm 120 relative to the upright 116 when the arm 120 is in the stowed position 126 (FIG. 6*c*, and shown in solid line in FIG. 3).

As a result, the width of the narrow gap 130 between the backrest 112 of the seat 104 and the adjacent edge 114 of the work surface 106 when the arm 120 is in the stowed position 126 may be increased or decreased by changing the rotational position of the eccentrically mounted button 210.

This feature can be advantageous for a variety of reasons. For example, it is generally desirable to have a stowed position 126 for the seats 104 wherein the backrest 112 of the seat 104 is close to, but not in contact with, the adjacent edge 114 of the work surface 106 (i.e. spaced by the narrow gap 130). If the backrest 112 contacts the work surface 106, premature wear or damage to the seating apparatus 100 could result. If the backrest 112 is spaced too far from the work surface 106 when the arm 120 is in the stowed position 126, clear passage behind the seat 104 is compromised. By providing an adjustable return stop element 206 or 208, the position of the seat 104 with respect to the work surface 106 when in the arm 120 is in the stowed position 126 can be optimized after installation of the seating apparatus 100, despite any expected variations in fabrication or assembly of the various apparatus components. Furthermore, by providing an adjustable return stop element 206, 208, all of the seats 104 in a row can be adjusted to be spaced equally apart from the work surface 106 by the narrow gap 130 when the seats 104 are in the stowed position 126, thereby providing a neat, professional appearance (FIG. 3).

Figure 7:
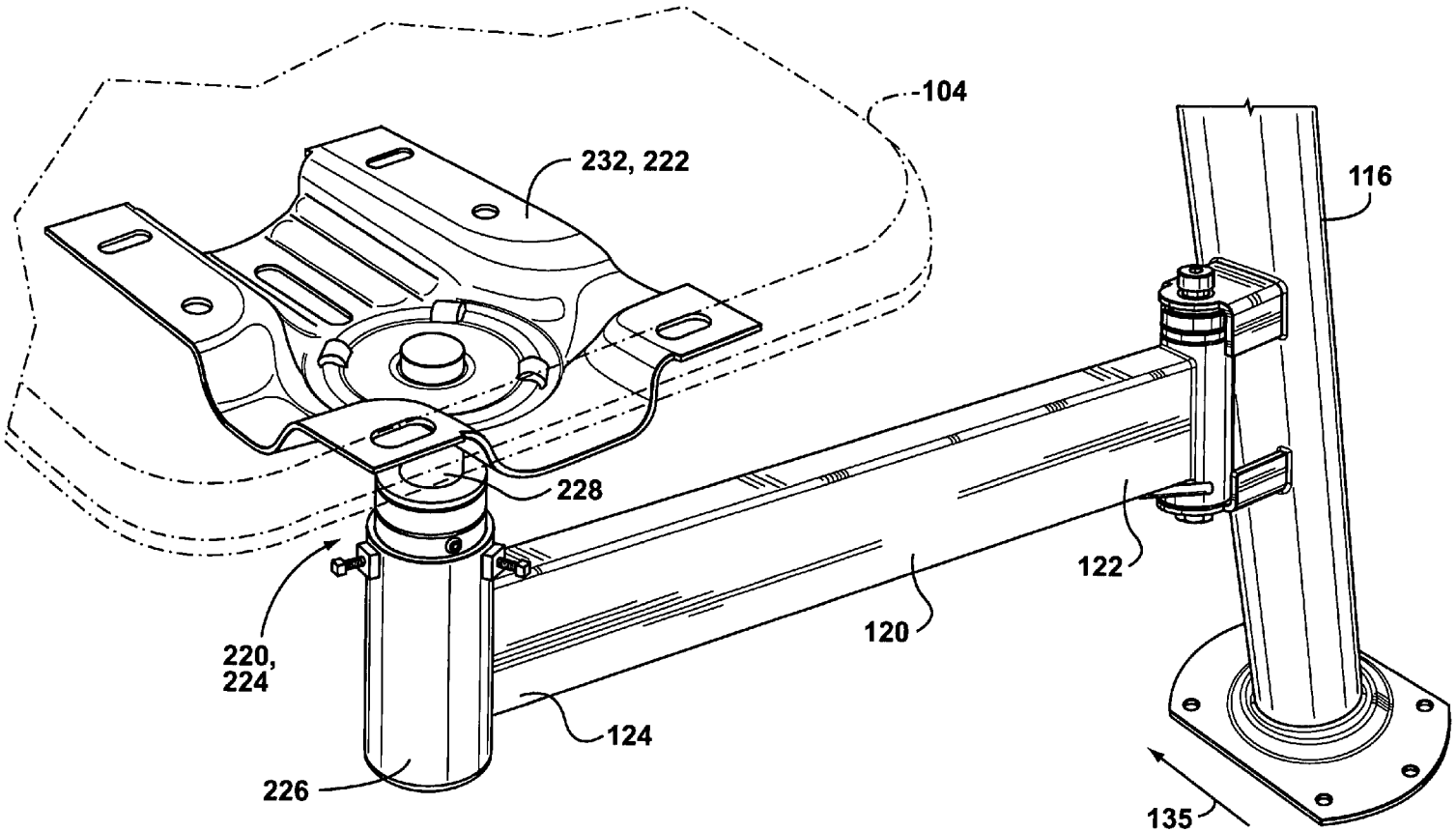
FIG. 7 is an enlarged perspective view of another portion of the apparatus of FIG. 1.

Referring now to FIG. 7, the outer end 124 of the arm 120 can be provided with a swivel mechanism 220 for swivelably mounting the seat 104 to the arm 120. The swivel mechanism 220 can enable the seat 104 to rotate to the left or to the right (counterclockwise or clockwise when viewed from above) from a central position 222 in which the seat 104 faces the forward direction 135. In the embodiment illustrated, when in the central position 222, the seat 104 is oriented such that the backrest 112 of the seat 104 is generally in parallel alignment with the adjacent edge 114 of the work surface (as seen in FIG. 3).

The swivel mechanism 220 can comprise a cartridge 224 fitted in a cylindrical housing 226 provided adjacent the outer end 124 of the swing arm 120. The swivel mechanism 220 can have orientation biasing means 228, for biasing the seat 104 to the central position 222.

In the embodiment illustrated, the cartridge 224 comprises a seat post 230 to which the seat 104 can be attached by means of a seat mounting bracket 232. The seat post 230 is rotatably supported by the cartridge 224, and the cartridge 224 is fixed within the housing 226.

Figures 8, 8A, 8B:
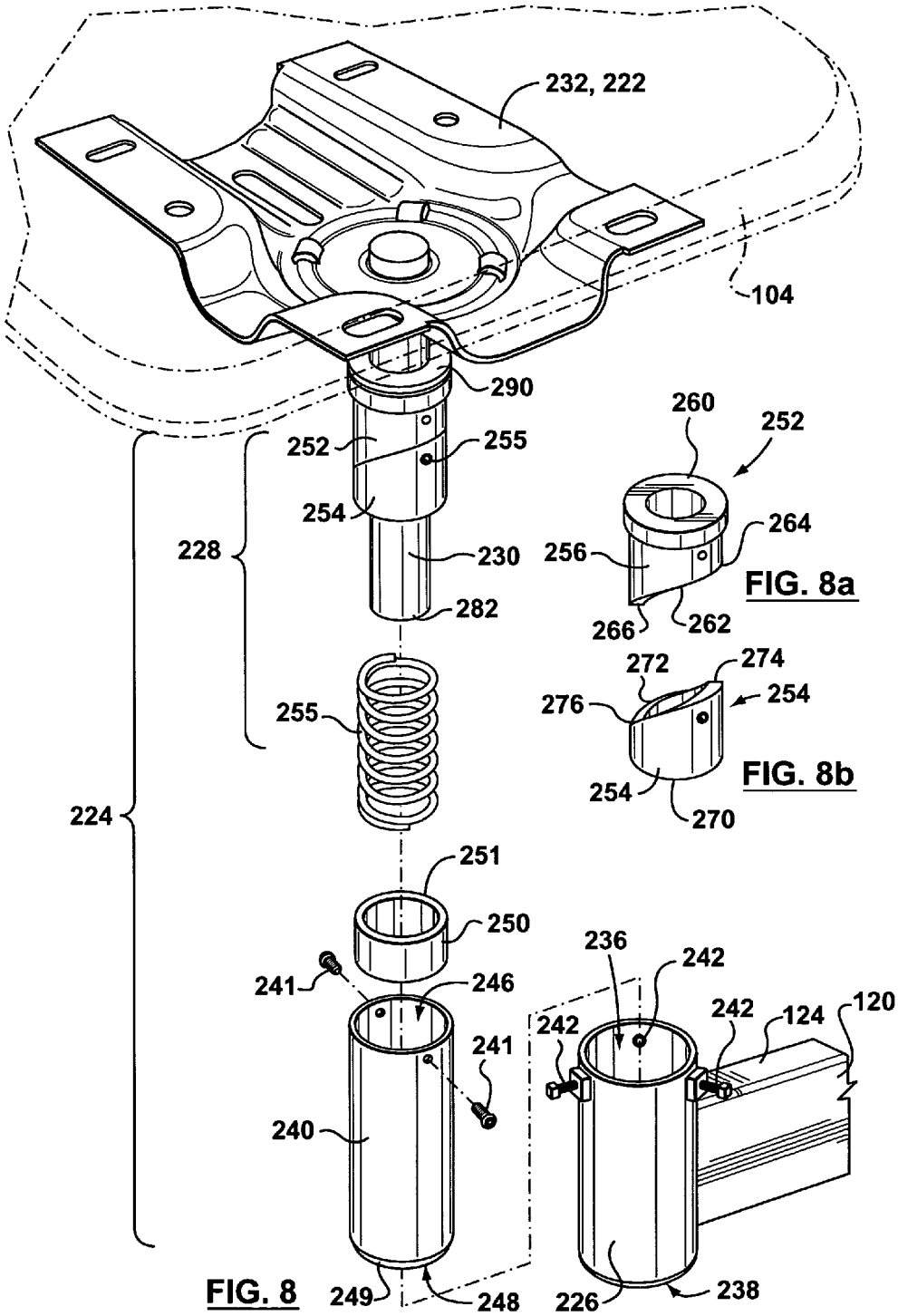
FIG. 8 is an exploded view of a portion of the apparatus of FIG. 3.
FIGS. 8*a* and 8*b* are perspective views of the upper and lower cams, respectively, of FIG. 8.

Referring now to FIG. 8, the housing 226 is generally cylindrical, having open upper and lower ends 236, 238, respectively. The cartridge 224 comprises a cylindrical sleeve 240 which is received in the housing 226. The sleeve 240 can be secured in the housing 226 by means of radial locking screws 242 provided around the circumference of the housing 226. In the embodiment illustrated, three locking screws 242 are provided.

The sleeve 240 is also generally cylindrical in shape, having open upper and lower ends 246 and 248, respectively. The lower end of the sleeve is provided with a radially inwardly directed retaining lip 249. The retaining lip 249 can be integrally formed with the sleeve 240, by means of, for example but not limited to, a swaging process. The inner diameter of the retaining lip is, in the embodiment illustrated, larger than the outer diameter of the seat post 230.

The cartridge 224 further comprises a lower bushing 250 positioned in the sleeve 240 adjacent the retaining lip 249. The bushing 250 has an outer diameter providing a sliding fit within the sleeve 240, and an inner diameter to provide a sliding fit with the outer surface of the post 230. A lower spring seat surface 251, characterized by generally flat, annular surface, is provided adjacent the upper axial face of the bushing 250.

The orientation biasing means 228 of the swivel mechanism 220 comprises upper and lower orientation cams 252, 254, respectively, and a compression spring 255, provided about the seat post 230 within the cartridge 224.

In the embodiment illustrated, with reference to FIGS. 8*a* and 8*b*, the upper and lower cams 252, 254 are in the form of annular collars having generally cylindrical outer side surfaces 256 and 258, respectively. The upper cam 252 has an inner diameter providing a sliding fit with the outer surface of the seat post 230. The upper end of the upper cam 252 comprises a radially outwardly extending flange 260. The lower end of the upper cam 252 is provided with an upper cam surface 262, which comprises a generally planar surface oriented at an incline to the axis of the seat post 230. The inclined upper cam surface 262 presents vertically uppermost and lowermost points 264 and 266, respectively.

The lower cam 254 has an inner diameter providing a snug fit with the outer surface of the seat post 230. The lower end of the lower cam 254 has a generally flat spring seat surface 270 oriented perpendicularly to the axis of the post 230. The upper end of the lower cam 254 is provided with a lower cam surface 272, which comprises a generally flat annular surface oriented at an incline to the axis of the seat post 230 that matches the incline of the upper cam surface 262. The inclined lower cam surface 272 presents vertically uppermost and lowermost points 274 and 276, respectively.

In the assembled cartridge 224, the lower cam 254 is fixed to the seat post 230, by, for example, a set screw 255, so that the seat post 230 and the lower cam 254 move together. The compression spring 255 is provided in the sleeve 240 between the lower bushing 250 and the spring seat surface 270 of the lower cam 254. The upper cam 252 is inserted in the sleeve 240 so that the flange 260 abuts the upper face of the sleeve 240, and the upper cam is fixed to the sleeve in that position. In the embodiment illustrated, radial locking rivets 241 extend through the sleeve 240 and engage the sides 256 of the upper cam 252 to lock the upper cam 252 in position relative to the sleeve 240.

Figure 10:
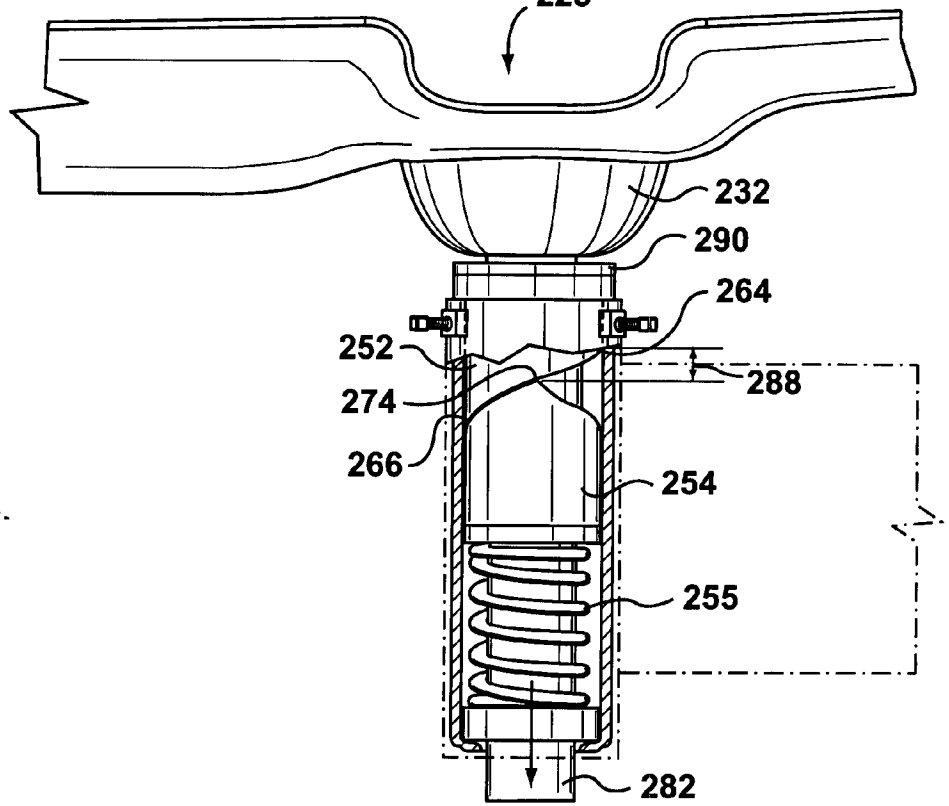
FIGS. 9 and 10 are side sectional views of the portion of the apparatus of FIG. 8 shown in a forward and in a sideways oriented position, respectively.
Figure 9:
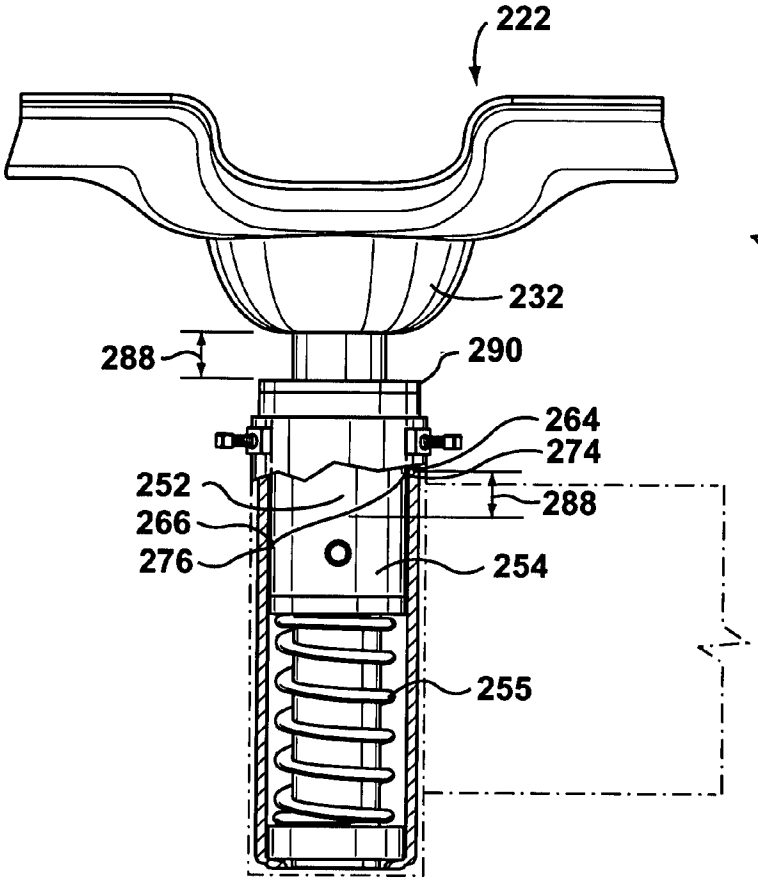

In use, the inclined cam surfaces 262 and 272 of the upper and lower cams 252, 254 are in substantially flush contact around the circumference of the cam surfaces 262, 272 when the seat 104 is in the central position 222 (FIGS. 8 and 9). When the seat 104 and seat post 230 are rotated (swiveled) in either direction, the lower cam 254 rotates with the post 230, and the post 230 and seat 104 are forced downward as the uppermost point 274 of the lower cam 254 follows the downwardly inclining cam surface 262 of the upper cam 252. This downward translation of the seat 104 compresses the spring 255 and causes the lower end 282 of the seat post 230 to protrude beyond the lower end of the lower bushing 250 (FIG. 10).

It is to be appreciated that the swivel mechanism 220 provides a relatively simple and inexpensive mechanism for swiveling the seat 104 and biasing the seat 104 to a central position 222.

Furthermore, the amount of rotation for swiveling the seat 104 can be limited by the vertical clearance 288 provided between the upper end of the cartridge 224 and the lower surface of the seat mounting bracket 232 fixed to the post 230. In the embodiment illustrated, about 90 degrees of rotation of the seat 104 uses up the available vertical clearance 288, causing the seat mounting bracket 232 to bottom out against the uppermost end of the cartridge 224, thereby defining the maximum swivel position 223 (FIG. 10). A metal washer 290 can be provided above the upper face of the flange 260 of the upper cam 252, to protect the flange 260 from damage that could result if the seat 104 is aggressively swiveled to its maximum rotation position.

When the seat 104 is released, the upward force of the compression spring 255 is transferred by the inclined cam surfaces 262, 272 of the cams 252, 254 into a rotational force, so that the seat 104 will swivel back to the central position 222. When in the central position 222, the lower cam 254 is at its vertically uppermost position, the adjacent cam surfaces 262, 272 of the cams 252, 254 are in substantially flush contact, and the spring 255 is in its least compressed state.

In combination with the pivoting action provided by the swing arm 120, it will be understood that an occupant of the seat 104, after entering the seat 104, can adjust the position of the seat 104 relative to the work surface 106 by swiveling the seat 104 and by pivoting the swing arm 120 to any desired position between the deployed 128 and stowed positions 126 of the arm 120. To exit the seat 104, an occupant can push back against the floor 108 and/or the work surface 106 using his or her feet and hands, respectively, so that the arm 120 is moved to the deployed position 128 and the access space 132 is provided between the backrest 112 of the seat 104 and the adjacent edge 114 of the work surface 106 (FIG. 2).

Upon releasing the unoccupied seat 104, the seat 104 will swivel to the central position 222 and the arm 120 will pivot to the stowed position 126. In this position, the backrest 112 of the seat 104 is preferably near, but not in contact with, the adjacent edge 114 of the work surface 106. The precise position of the backrest 112 of the seat 104 relative to the adjacent edge 114 of the work surface 106 can be adjusted using the adjustable dynamic return stop element 210 of the illustrated embodiment, as previously described.

Figure 11:
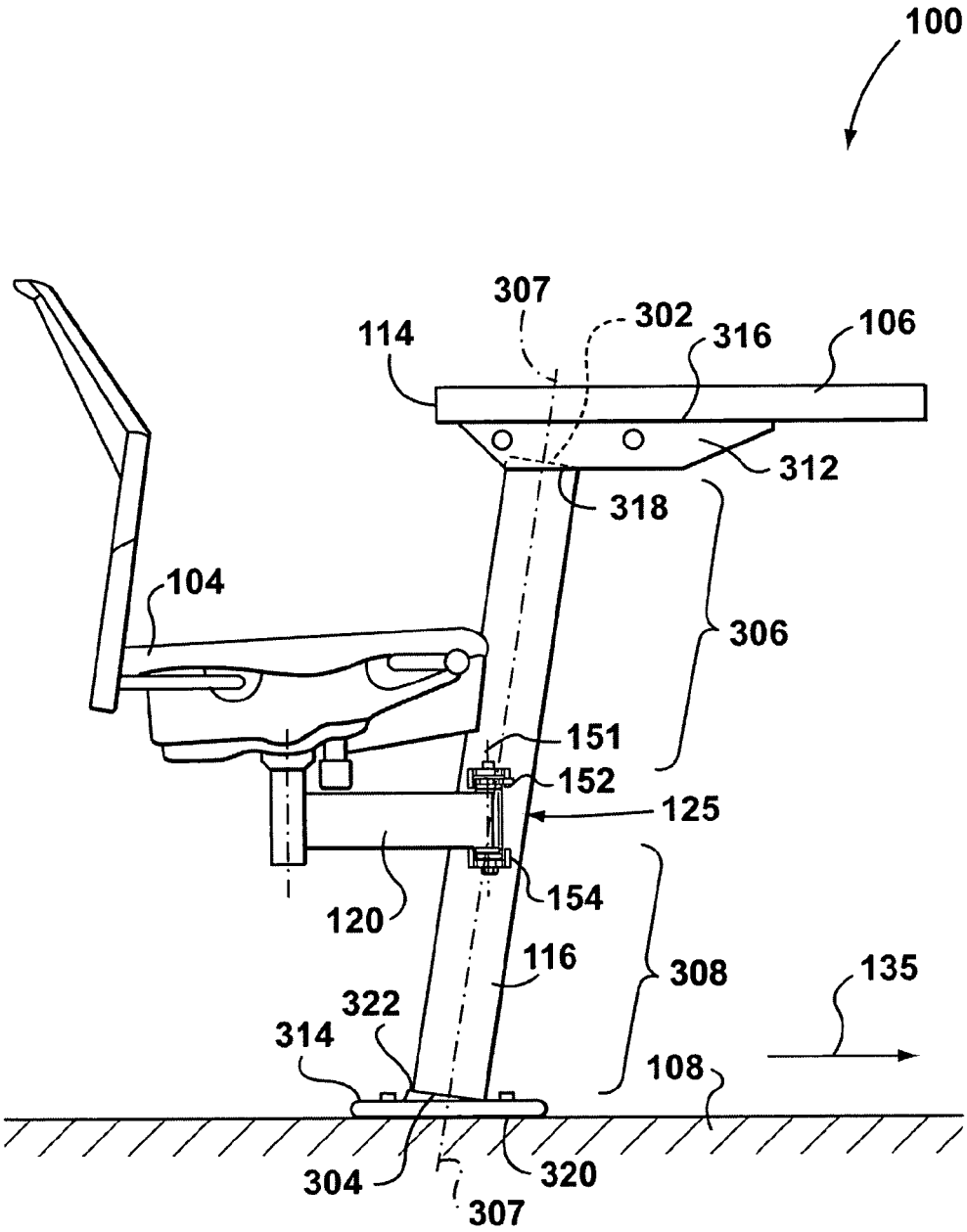
FIG. 11 is an enlarged side view showing further details of the apparatus of FIG. 2.

According to another feature of the present invention, and with reference now to FIG. 11, the uprights 116 of the seating apparatus 100 can be inclined from the vertical, such that the upright 116 has opposed upper and lower ends 302 and 304, respectively, with the upper end 302 positioned forward (relative to the direction 135) of the lower end 304 of the upright 116.

The inclined upper portion 306 of the upright 116 (between the work surface 106 and the pivot joint 125) advantageously positions the pivot axis 151 of the pivot joint 125 further rearward relative to the adjacent edge 114 of the work surface 106 than would be possible with a more vertical upright. The inclined lower portion 308 of the upright 116 (between the floor 108 and the pivot joint 125) enables a straight length of material to be used as the upright 116.

In the embodiment illustrated, the upright 116 comprises a straight length of steel pipe having an axis 307. The upper and lower ends 302 and 304 of the upright 116 are cut at right angles to the axis 307 of the upright 116. By using a straight but inclined upright 116, the need of a more costly two-piece, or bent, upright is avoided. Furthermore, by having square ends 302 and 304, more costly oblique cuts are avoided.

Since the pivot axis 151 is generally vertical, as desired for the swing arm 120 to pivot in a horizontal plane, the pivot axis 151 is correspondingly inclined to the axis 307 of the upright 116. In the illustrated embodiment, the upper and lower brackets 152, 154 of the pivot joint 125 are offset to opposite sides of the centerline of the upright 116, and oriented to vertically opposed each other (FIG. 11). The brackets 152, 154 are then welded in place to the upright 116.

To provide attachment to the work surface 106 and the floor 108, the upper and lower ends 302, 304 of the upright 116 are fitted with a work surface bracket 312 and a floor bracket 314, respectively. The work surface bracket 312 can have a generally horizontal mounting surface 316 to which the work surface 106 can be secured. The work surface bracket 312 can further be provided with an inclined attachment surface 318 to which the upper end 302 of the upright 116 can be fastened. The inclined attachment surface 318 can be inclined relative to the mounting surface 316 to abut the upper end 302 of the upright 116 in generally flush contact.

The floor bracket 314 can have a generally horizontal bearing surface 320 to bear against the floor 108. The floor bracket 314 can further be provided with another inclined attachment surface 322 to which the lower end 304 of the upright 116 can be fastened. The inclined attachment surface 322 can be inclined relative to the bearing surface 320 to abut the lower end 304 of the upright 116 in generally flush contact, while maintaining a generally horizontal orientation of the bearing surface 320. Alternatively, the inclined surface 322 of the floor bracket 314 can be inclined relative to the bearing surface 320 such that the bearing surface 320 is not horizontal, but is inclined from the horizontal to match an inclined floor surface, such as commonly found in auditoriums with downward sloping floors.

While preferred embodiments of the invention have been described herein in detail, it is to be understood that this description is by way of example only, and is not intended to be limiting. The full scope of the invention is to be determined from reference to the appended claims.

What is claimed is:

1. A seating apparatus comprising:

a) a support element having an upright extending from a floor and a swing arm pivotably mounted to the upright about a generally vertical pivot axis;

b) a work surface secured to the upright above the swing arm;

c) a seat mounted on the swing arm, the seat having a seat base upon which an occupant can be seated;

d) the swing arm being pivotable between a stowed position wherein the seat base is tucked substantially underneath the work surface, and a deployed position wherein the seat base is substantially clear of the work surface; and e) a flat coiled torsion spring for biasing the swing arm to the stowed position, the torsion spring having a first end fixed directly or indirectly to the upright and a second end fixed directly or indirectly to the swing arm, the flat coiled torsion spring comprising a thin strip of resilient metal coiled in a flat spiral about the pivot axis.

2. The apparatus of claim 1 wherein the swing arm is pivotable about a pivot joint comprising upper and lower brackets extending from the upright to vertically straddle an inner end of the swing arm, a bore provided in the straddled inner end of the swing arm, and a generally vertical pin supported by the brackets and extending through the bore of the swing arm, the swing arm being pivotable about the pin.

3. The apparatus of claim 2 further comprising a boss fixed to pivot with the swing arm, the boss extending axially between the swing arm and an adjacent one of the upper and lower brackets of the pivot joint.

4. The apparatus of claim 3 wherein the pivot joint further comprises a bushing provided in the bore, the bushing having an outer surface sized to fit snugly within an inner surface of the bore, and an inner diameter sized to provide a sliding fit with the pin.

5. The apparatus of claim 4 wherein the boss extends from the bushing.

6. The apparatus of claim 4 further comprising anti-rotate means adjacent the bushing and the bore for preventing relative motion between the bushing and bore.

7. The apparatus of claim 6 wherein the anti-rotate means comprises an axial groove along the outer surface of the bushing and a radially inwardly directed key extending from the inner surface of the bore and engaging the groove of the bushing.

8. The apparatus of claim 3 wherein the second end of the torsion spring is fixed to the boss, and the first end of the torsion spring is fixed to the adjacent one of the upper and lower brackets of the pivot joint.

9. The apparatus of claim 8 wherein the adjacent one of the upper and lower brackets has a generally vertical gusset with an exposed edge extending adjacent the boss.

10. The apparatus of claim 9 wherein the first end of the torsion spring comprises a radially outwardly extending hook that is hooked onto the exposed edge of the gusset.

11. The apparatus of claim 8 wherein the boss extends axially through the center of the torsion spring.

12. The apparatus of claim 11 wherein the second end of the torsion spring comprises a tab directed radially inwardly, and the boss has a transverse slot to engage the tab.

13. The apparatus of claim 1 further comprising a swivel mechanism for swivelably supporting the seat above the swing arm, the swivel mechanism biasing the seat in a central direction.

14. The apparatus of claim 13 wherein the swivel mechanism comprises:

a) a sleeve fixed to an outer end of the swing arm, the sleeve having open upper and lower ends;

b) a post rotatable within the sleeve, the post having an upper end for attachment to a seat;

c) an upper cam fixed within the sleeve and a lower cam fixed to the post and slidable within the sleeve, the upper cam disposed between the lower cam and the upper end of the post; the upper and lower cams having matching inclined annular lower and upper surfaces, respectively, wherein the position of the lower cam relative to the upper cam providing generally flush contact of the matching inclined annular surfaces defines the central position of the swivel mechanism; and d) a compression spring urging the lower cam against the upper cam.

15. The seating apparatus of claim 1 wherein the upright has an upper end adjacent the work surface and a lower end opposite the upper end, the upright extending continuously along a straight axis between the upper and lower ends, and the upright adapted to be inclined from the vertical when in use, such that, relative to a direction in which the seating apparatus is facing, the upper end of the upright is forward of the pivot joint, and the pivot joint is forward of the lower end of the upright.

16. The apparatus according to claim 15 wherein the upper and lower ends of the upright are generally perpendicular to the axis of the upright.

17. The apparatus according to claim 16 further comprising a work surface mounting bracket adjacent the upper end of the upright for mounting the work surface obliquely with respect to the generally perpendicular upper end of the upright.

18. A support element for a seating apparatus, the support element comprising:

a) an upright for supporting a work surface above a floor;

b) a swing arm for supporting a seat, the swing arm pivotably mounted to the upright and pivotable between a stowed position wherein a seat supported by the swing arm is substantially underneath a work surface supported by the upright, and a deployed position wherein a seat supported by the swing arm is substantially clear of a work surface supported by the upright; and c) a flat coiled torsion spring for biasing the swing arm to the stowed position, the torsion spring having a first end fixed directly or indirectly to the upright and a second end fixed directly or indirectly to the swing arm, the flat coiled torsion spring comprising a thin strip of resilient metal coiled in a flat spiral about the pivot axis.

19. The support element of claim 18 further comprising a dynamic return stop element secured to the swing arm and a static return stop element secured to the upright, the dynamic and static return stop elements positioned in a common horizontal plane and abutting each other when the swing arm is in the stowed position, at least one of the static and dynamic return stop elements being adjustable to change the angular position of the swing arm relative to the upright corresponding to the position at which the dynamic and static return stop elements abut.

20. The support element of claim 19 wherein the dynamic return stop element comprises an eccentrically mounted button, the button having an attachment axis about which the button can be rotatably adjusted, and an outer surface spaced laterally away from the attachment axis for contacting the static return stop element.

21. The support element of claim 20 wherein the static return stop element comprises a bracket extending from the upright.

22. The support element of claim 21 wherein the bracket has at least one generally vertical gusset, and the static return stop element comprises an exposed edge of the gusset.

* * * * *